US007989764B2

(12) United States Patent
Yasuda et al.

(10) Patent No.: US 7,989,764 B2
(45) Date of Patent: Aug. 2, 2011

(54) ION TRAP MASS SPECTROMETRY METHOD

(75) Inventors: Hiroyuki Yasuda, Hitachinaka (JP); Shinji Nagai, Hitachinaka (JP); Tetsuya Nishida, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 644 days.

(21) Appl. No.: 11/889,232

(22) Filed: Aug. 10, 2007

(65) Prior Publication Data

US 2008/0054173 A1 Mar. 6, 2008

(30) Foreign Application Priority Data

Sep. 4, 2006 (JP) ..... 2006-239070

(51) Int. Cl.
*H01J 49/42* (2006.01)
*H01J 49/40* (2006.01)

(52) U.S. Cl. ..... 250/292; 250/282; 250/287; 250/281

(58) Field of Classification Search ..... 250/292, 250/281, 282
See application file for complete search history.

(56) References Cited

U.S. PATENT DOCUMENTS 4,736,101 A 4/1988 Syka et al.
5,479,012 A 12/1995 Wells
5,572,022 A 11/1996 Schwartz et al.
5,640,011 A 6/1997 Wells
5,864,136 A * 1/1999 Kelley et al. ..... 250/282
6,121,610 A * 9/2000 Yoshinari et al. ..... 250/292
6,541,766 B2 * 4/2003 Kato ..... 250/282
6,627,876 B2 9/2003 Hager
6,815,673 B2 * 11/2004 Plomley et al. ..... 250/292
7,378,653 B2 * 5/2008 Wells ..... 250/292
7,586,089 B2 * 9/2009 Hartmer ..... 250/282
2001/0002696 A1 * 6/2001 Kato ..... 250/281
2002/0162958 A1 * 11/2002 Yoshinari et al. ..... 250/292
(Continued)

FOREIGN PATENT DOCUMENTS

JP 62-37861 2/1987
(Continued)

OTHER PUBLICATIONS

Japanese Office Action issued in Japanese Patent Application No. 2006-239070, dated Feb. 3, 2009.

*Primary Examiner* — Jack I. Berman
*Assistant Examiner* — Johnnie L Smith
(74) *Attorney, Agent, or Firm* — McDermott Will & Emery LLP

(57) ABSTRACT

According to an aspect of the present invention, there are provided an ion trap mass spectrometry method and an ion trap mass spectrometry device using a mass spectrometer, the mass spectrometer including: an ion source part for ionizing a sample; an ion trap part for trapping ions generated in the ion source; a main high frequency power source for applying a main high frequency voltage to the ion trap part, and an auxiliary high frequency power source for applying an auxiliary high frequency voltage thereto; and a detector for detecting the ions ejected from the ion trap. The ion trap mass spectrometry method and the ion trap mass spectrometry device includes the steps of: accumulating desired ions into the ion trap part by ejecting undesired ions while accumulating ions into the ion trap part; and ejecting undesired ions that remain in the ion trap part and leaving the desired ions in the ion trap part are repeated alternately.

7 Claims, 9 Drawing Sheets

U.S. PATENT DOCUMENTS

| | | | | |
|---|---|---|---|---|
| 2002/0185596 | A1* | 12/2002 | Amy et al. | 250/292 |
| 2003/0085349 | A1* | 5/2003 | Kato | 250/292 |
| 2003/0150988 | A1* | 8/2003 | Wells | 250/292 |
| 2003/0150989 | A1* | 8/2003 | Yoshinari et al. | 250/292 |
| 2003/0222211 | A1* | 12/2003 | Okumura et al. | 250/287 |
| 2004/0149903 | A1* | 8/2004 | Wang | 250/292 |
| 2004/0159785 | A1* | 8/2004 | Kato | 250/292 |
| 2004/0211898 | A1* | 10/2004 | Yoshinari et al. | 250/292 |
| 2005/0145790 | A1* | 7/2005 | Wang | 250/292 |
| 2007/0158550 | A1* | 7/2007 | Wells | 250/292 |
| 2007/0176098 | A1* | 8/2007 | Wells | 250/292 |

FOREIGN PATENT DOCUMENTS

| | | |
|---|---|---|
| JP | 9-5298 | 1/1997 |
| JP | 2002-184348 | 6/2002 |
| JP | 2002-313276 | 10/2002 |
| JP | 2006-092750 | 4/2006 |
| WO | WO 94/28575 | 12/1994 |

* cited by examiner

ION TRAP MASS SPECTROMETRY METHOD

BACKGROUND OF THE INVENTION

1. Field of the Invention

The present invention relates to a mass spectrometry method and a mass spectrometry device using an ion trap mass spectrometer.

2. Description of the Related Art

A mass spectrometer is an instrument that ionizes a sample molecule by applying an electric charge thereto and separates the generated ions according to their mass to charge ratio by an electric field or by a magnetic field, and then measures the quantity as a current value with a detector.

A mass spectrometer has high sensitivity and is also excellent in quantitative and identification capabilities as compared to the conventional analyzers. In recent years, peptide analysis carried out in place of genomic analysis attracts an attention in the field of life science, and thus effectiveness of a mass spectrometer, which has high sensitivity and is excellent in identification capability, has been reassessed.

The measurement of a sample by a mass spectrometer gives a current value in the unit of mass to charge ratio. This is referred to as a mass spectrum. This mass spectrum varies according to the structure of a sample to be measured, and information on the structure of the sample can be obtained from the pattern of this mass spectrum.

However, in some cases, constituents within a sample are complicated or the obtained mass spectrum is information insufficient for identifying the constituents.

Especially in a mass spectrometer, molecular ions are separated according to their mass to charge ratios, so if the mass to charge ratios are the same in spite of different structures, it is difficult to distinguish the molecular ions. In order to solve this, an $MS^n$ analysis is devised.

In the $MS^n$ analysis: molecular ions are introduced into a mass spectrometer; ions other than an ion having a specific mass number are removed from the mass spectrometer; a collision between the selected molecular ion thereby and a neutral molecule is caused to break the bond of a part of the molecular ion; and the ions having the broken bond are measured.

The breaking of the bond of a selected molecular ion, which is caused to collide with this neutral molecule, is referred to as collision induced dissociation (CID), and is referred to as $MS^2$, $MS^3$ and the like according to the number of repetitions of a series of operations of ion accumulation, ion isolation and collision induced dissociation.

For the bond between atoms within a molecule, the bond energy varies according to the structure thereof and the type of bond, and therefore a portion having a lower bond energy is likely to be broken by collision induced dissociation.

During a collision between a molecular ion and a neutral molecule, a kinetic energy required for breaking the bond is applied to the molecular ion to thereby form fragment ions peculiar to the molecular ion, allowing the structure of the molecular ion to be known.

Moreover, as the number of repetitions of $MS^n$ analysis increases, more structure information can be obtained.

As a mass spectrometer, various types are listed according to the operation and configuration for separating ions, and one of the configurations suitable for conducting $MS^n$ analysis is an ion trap mass spectrometer.

The ion trap mass spectrometer can carry out ion isolation and collision induced dissociation by forming such quadrupolar electric field that ions having a particular mass to charge ratio will stay in an ion trap, and then by varying the quadrupolar electric field.

When a first round of collision induced dissociation is carried out, the resultant ions produced may be subjected to a second round of ion isolation and of collision induced dissociation instead of being induced to a detector. In this way, it is possible to conduct a plurality of $MS^n$ analyses.

The operation of ion trap is mainly divided into four operations in conducting the $MS^n$ analysis.

1. Apply a main high frequency voltage to a ring electrode to form a quadrupolar electric field in the ion trap.

Since ions generated outside or inside of the ion trap have an electric charge, if the ions are introduced in the quadrupolar electric field, the ions with a mass to charge ratio corresponding to a value and q value that exist in the region of a hatched portion in a stability region diagram shown in FIG. 1 will draw a stable trajectory and be accumulated in the ion trap.

These a value and q value are determined by Equation (1) using the main high frequency voltage V, the main direct current voltage U, the inner radius $r_0$ of the ring electrode, the angular frequency Ω of the main high frequency voltage, and the mass to charge ratio m/z of the ion.

$$q_z = \frac{4zV}{(mr_0^2\Omega^2)} \qquad \text{Equation (1)}$$

$$\alpha_z = \frac{8zU}{(mr_0^2\Omega^2)}$$

The operation to accumulate ions in the ion trap in this manner is referred to as the ion accumulation operation.

Since in the ion accumulation operation, the operation is carried out under a condition of a=0 without applying the main direct current voltage (U), ions to be accumulated are uniquely determined on a=0 line in the stability region diagram according to their mass to charge ratio.

The q value is in the range of 0 to 0.908, and the ions having the mass to charge ratio corresponding to this range are accumulated in the ion trap.

2. The accumulated ions draw a stable trajectory at respective natural frequencies of plural components according to their mass to charge ratio in the ion trap. $\omega_0$, which is one of the frequency components, can be estimated from a $\beta_z$ value shown in the stability region diagram of FIG. 1 and Equation (2).

$$\omega_0 = \frac{\beta_z\Omega}{2} \qquad \text{Equation (2)}$$

If an auxiliary alternate current voltage corresponding to this frequency is applied to an end cap electrode, ions will resonate and be ejected from the ion trap by an auxiliary alternate current electric field generated in the ion trap.

If this operation is carried out to the undesired ions not subjected to structure analysis, i.e., not subjected to collision induced dissociation, the ions will be ejected from the ion trap and only the desired ions will be accumulated in the ion trap. This is referred to as the ion isolation operation.

3. Then, if a frequency, which resonates with the desired ions subjected to collision induced dissociation, is applied to the end cap electrode to such an extent that the desired ions are not ejected, then the ions obtain a potential by the auxiliary alternate current electric field and repeats a collision with the neutral molecule inside the ion trap, so that a bond in the ion is broken to generate fragment ions. This is referred to as the collision induced dissociation operation.

4. The repeating of these ion isolation operation and collision induced dissociation operation allows for $MS^n$ analysis, and by operating the ring electrode and the end cap electrode after the fragment ions worth obtaining the structure information are accumulated in the ion trap, the ions reach a detector according to their mass to charge ratio, where the ion quantity corresponding to the mass to charge ratio is detected as a current value.

The examples indicating such ion trap operation include Japanese Patent Translation Publication. No. 9-501536, Japanese Patent Application Laid-Open Publication No. 2002-184348, Japanese Patent Application Laid-Open Publication No. 2002-313276 and the like.

SUMMARY OF THE INVENTION

In the collision induced dissociation operation to cleave the desired ions, an auxiliary high frequency voltage of a motion frequency corresponding to the mass to charge ratio of the desired ions is applied to the end cap electrode at a frequency obtained by Equation (2) to excite the ions, while keeping the ions accumulated by the main high frequency voltage applied to the ring electrode.

The excited ions are transformed into an internal energy due to the collision with the neutral molecule in the ion trap, and if a plurality of collisions are repeated, the intramolecular bond will be broken.

The ion trap mass spectrometer has an advantage of high sensitivity over other mass spectrometers because it accumulates the ions in a quadrupolar electric field once unlike the operation of a collision cell, such as a triple quadrupolar mass spectrometer.

However, since the ions in the ion trap have obtained a kinetic energy by resonance excitation due to the auxiliary high frequency field, the ion trap mass spectrometer has the following drawbacks.

The ions accumulated in the ion trap are molecules or atoms having an electric charge. If a plenty of ions exist in a certain space, an electric field drop will occur. The ions in the dropped electric field cannot resonate due to the auxiliary high frequency voltage at the frequency shown in Equation (2).

This causes problems such as that the desired ions are ejected during the ion isolation, and that the collision energy cannot be provided to the desired ions when carrying out the collision induced dissociation operation.

This overcrowding state of electric charges is usually called space charge. It is a phenomenon which is likely to occur especially in the ion trap where the ions are accumulated once, and is therefore the problem to be solved.

In order to solve this problem, as the conventional art, a method below is cited.

This method is a method of adjusting the ion accumulation time in the ion accumulation step, and thereby adjusting the ion quantity to be accumulated in the ion trap, as described in Japanese Patent Application Laid-Open Publication No. 9-306419.

In this method, MS measurement (prescan) is carried out immediately before carrying out MS/MS. Thereafter, after the quantity of ions currently existing in the ion trap is confirmed, the ion accumulation time of the MS/MS measurement is modified.

The ion accumulation time and the ion quantity are in proportional relation, so when the ions are excessive, the space charge can be suppressed by shortening the ion accumulation time.

However, since in this method the adjustment of the ion quantity is carried out to all the ions existing in the ion trap, the MS/MS spectrum of desired ions may not be obtained.

For example, in the case where there are a plenty of undesired ions, and where there are few desired ions, if the ion accumulation time is shortened, the quantity of desired ions cannot be secured enough to obtain the MS/MS spectrum. As a result, the structure information will not be obtained.

Such inconvenience occurs frequently, especially in measuring a minor constituent in an unrefined specimen, such as a living body.

In view of the above-described problems, the present invention is intended to provide an ion trap mass spectrometry method and an ion trap mass spectrometry device in which the desired ions can be secured sufficiently, and in which the MS/MS measurement is optimized.

According to an aspect of the present invention, the desired ions are collected in an ion trap part by ejecting the undesired ions while accumulating ions into the ion trap part.

More specifically, the present invention is configured as follows.

A mass spectrometer includes: an ion source part for ionizing a sample; and a ion trap part which entraps, the ions generated in the ion source, according to a predetermined mass to charge ratio by forming a three-dimensional quadrupolar electric field, which ejects the undesired ions, which entraps only the desired ions in the quadrupolar electric field, which carries out collision induced dissociation to generate fragment ions, which then mass-separates these ions, and which transports to a detector; and the detector that converts the quantity of ions into a current value. In the mass spectrometer, the quantity of accumulated ions and the quantity of desired ions in the ion accumulation operation are optimized in order to carry out MS/MS measurement thereto, and then the ion isolation operation and collision induced dissociation operation are carried out to obtain an MS/MS spectrum.

According to the present invention, MS measurement is carried out prior to the MS/MS measurement, and a total ion quantity of the mass spectrum and the quantity of desired ions are measured. Then, the quantity of ions to be accumulated in the ion trap is set to be only the desired ions. Thereafter, this ion quantity is adjusted to an optimum quantity in carrying out the MS/MS measurement.

Moreover, according to the present invention, in a phase where only the desired ions are accumulated in the ion trap, the quantity of desired ions is subtracted from the total ion quantity to calculate the quantity of undesired ions, and then the optimum time for ejecting the undesired ions from the ion trap is determined. After ejecting the undesired ions from the ion trap completely, MS/MS measurement is carried out.

Furthermore, according to the present invention, in the above-described phase where the quantity of desired ions is adjusted to a quantity optimum for carrying out MS/MS measurement, the ion accumulation time is determined so that the quantity of desired ions can become the ion quantity suitable for the MS/MS measurement. In addition, in order to eject the undesired ions completely, the MS/MS measurement is carried out after ejecting the undesired ions without introducing ions into the ion trap.

Still furthermore, according to the present invention, in the above-described phase where the quantity of desired ions is adjusted to a quantity optimum for carrying out MS/MS measurement, the ion accumulation and the undesired-ion ejection are carried out a plurality of times so that the quantity of desired ions can become an ion quantity suitable for the MS/MS measurement. Then, the MS/MS measurement is carried out.

Even still furthermore, according to the present invention, the optimum quantity of desired ions can be set in a user interface.

According to the present invention, it is possible to optimize the quantity of accumulated ions and the quantity of desired ions in accumulating the ions, and thus to obtain an improvement in the intensity of fragment ions and an excellent reproducible MS/MS spectrum in the MS/MS measurement.

DESCRIPTION OF THE PREFERRED EMBODIMENTS

Hereinafter, embodiments of the present invention will be described with reference to the accompanying drawings.

Figure 1:
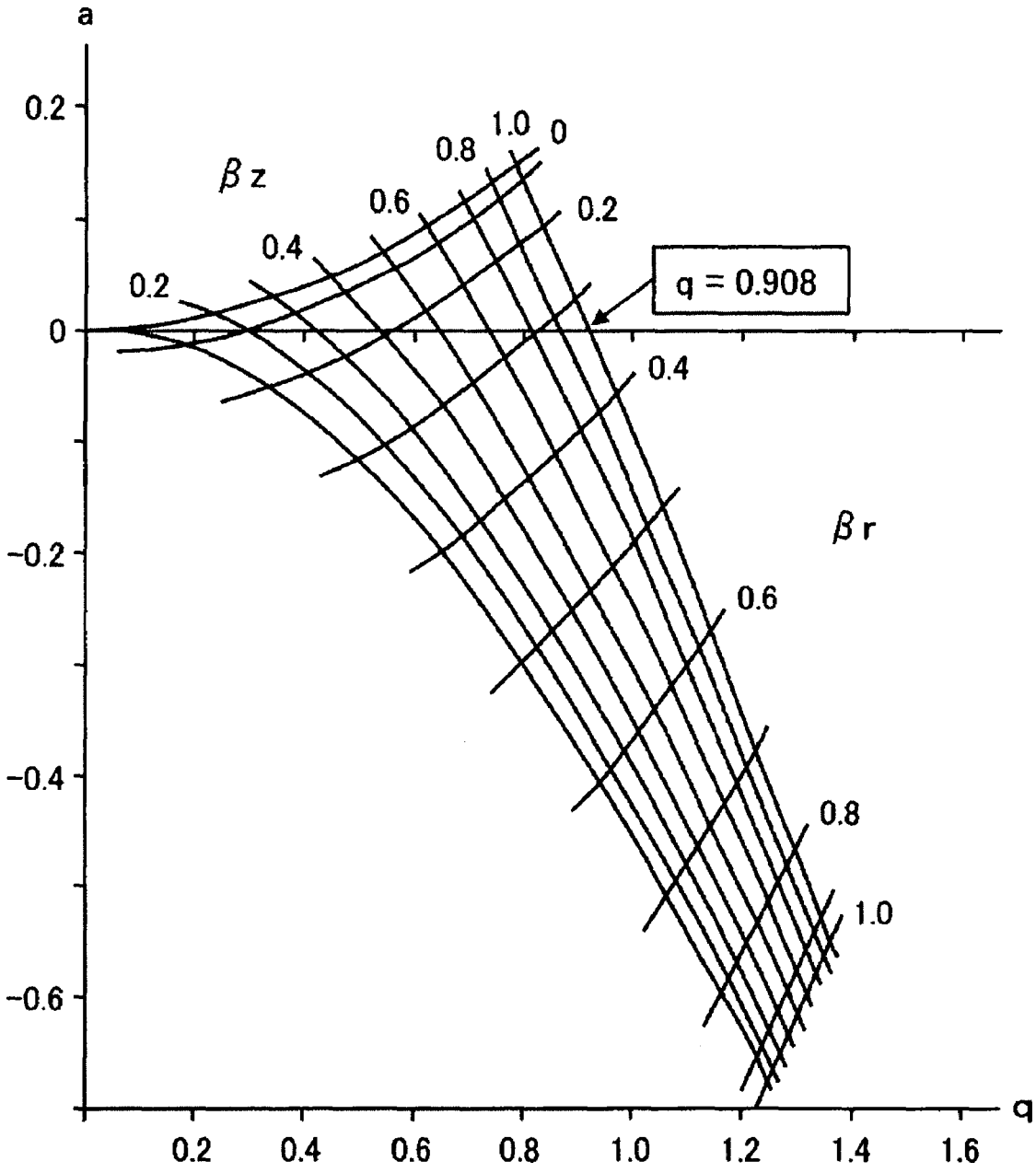
FIG. 1 is a stability region diagram of an ion trap of an ion trap mass spectrometer.
Figure 2:
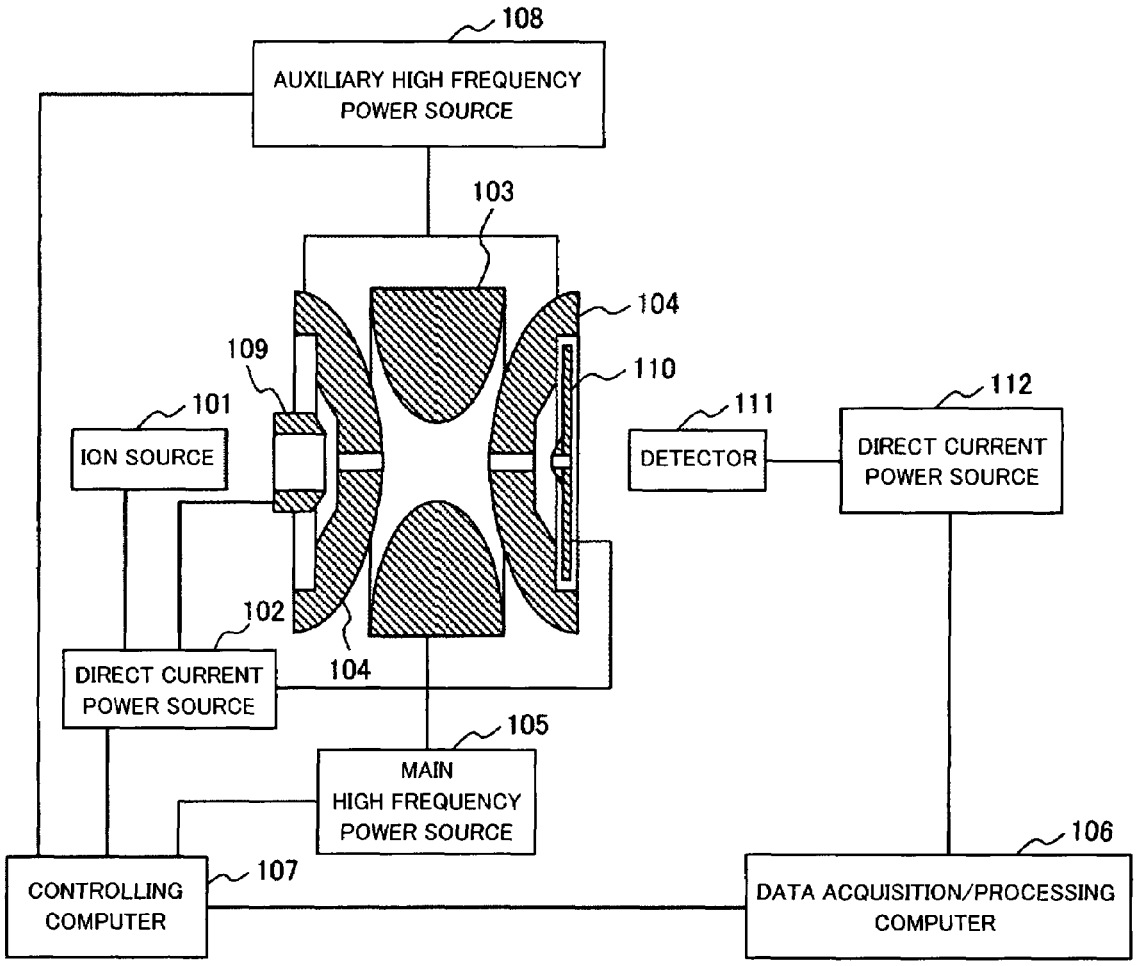
FIG. 2 is a schematic configuration view concerning an embodiment of the present invention.

FIG. 2 shows a schematic configuration view of this embodiment.

An ion source 101 ionizes a sample by applying a voltage of several kV thereto from a direct current power source 102. An ion trap includes a doughnut-shaped ring electrode 103, and two bowl-shaped end cap electrodes 104 that sandwich the ring electrode 103 therebetween. A high frequency power source is connected to each electrode.

A main high frequency power source 105 applies a main high frequency voltage to the ring electrode 103 upon receipt of an instruction to entrap ions into the ion trap from a data acquisition/processing computer 106 and a controlling computer 107, for the purpose of forming a quadrupolar electric field in the ion trap.

Moreover, an auxiliary high frequency power supply 108 applies, to the end cap electrodes 104, an auxiliary high frequency voltage of a frequency corresponding to the mass to charge ratio of the undesired ions to eject or corresponding to the mass to charge ratio of the desired ions subjected to collision induced dissociation and further corresponding to the mass to charge ratio of the ions subjected to mass separation, for the purpose of forming an auxiliary high frequency field for carrying out the ion isolation and collision induced dissociation.

This can be controlled by the data acquisition/processing computer 106 and controlling computer 107, as in the main high frequency power source 105.

Moreover, a gate electrode 109 and an ion stop electrode 110 are arranged at the preceding stage of the ion trap and at the subsequent stage, and a direct current voltage is applied thereto from the direct current power source 102.

These electrodes can be controlled by the data acquisition/processing computer 106 and controlling computer 107 so that ions can be guided efficiently when introducing or ejecting the ions to/from the ion trap.

At the subsequent stage of the ion stop electrode 110, there are provided a detector 111 that detects the quantity of ions and converts into a current value, and a direct current amplifier 112 that amplifies this current value. This value is displayed as a total ion quantity or as a mass spectrum on the data acquisition/processing computer 106.

Next, a method of controlling the ion trap is described.

Figure 3:
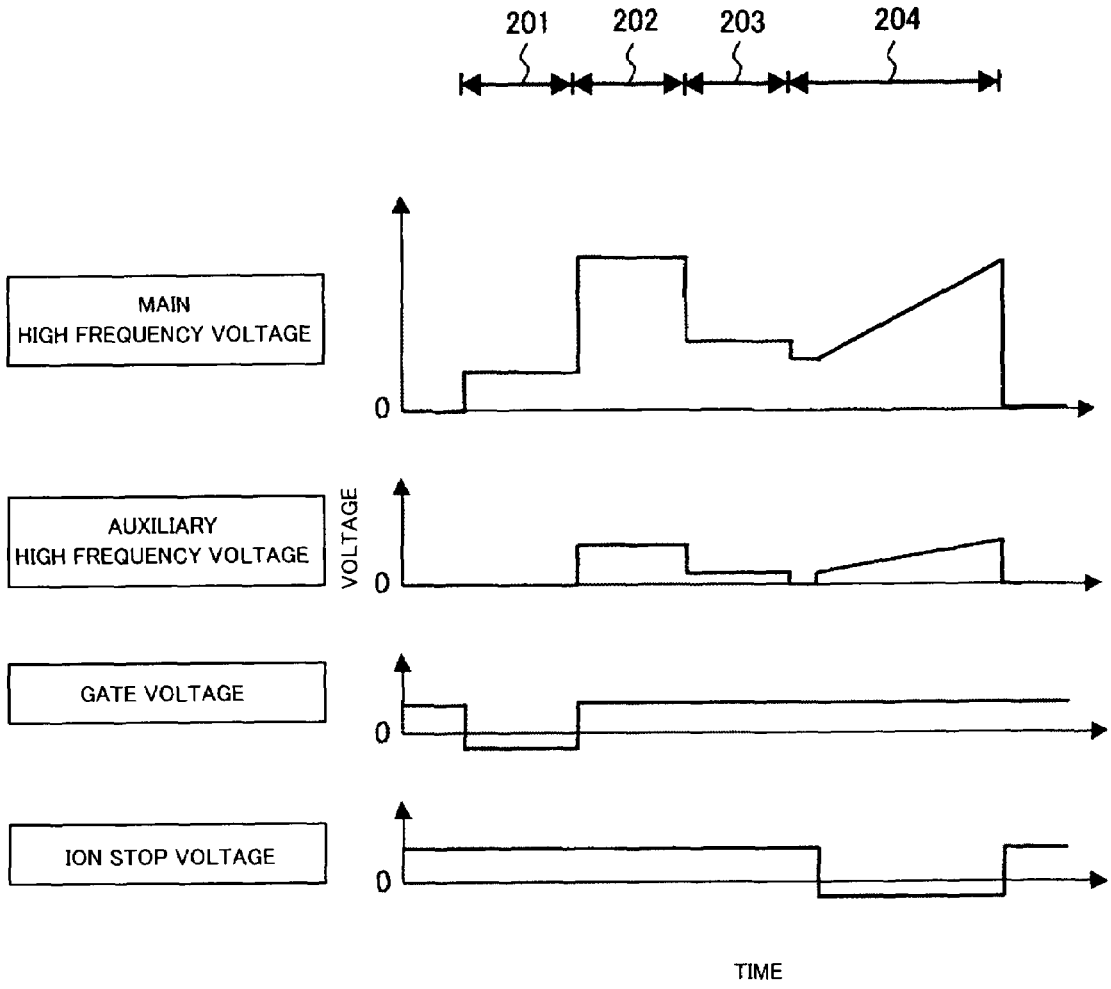
FIG. 3 is a control sequence of an ion trap operation in the ion trap mass spectrometer.

FIG. 3 shows a timing chart of voltages applied to each of the electrodes in the ion trap.

This timing chart shows the horizontal axis as time and the vertical axis as the magnitude of electric potential, schematically describing the electric potential graph applied to each electrode when conducting MS/MS analysis in the ion trap.

Each voltage indicates, from the upper row in the view, a main high frequency voltage applied to the ring electrode 103, an auxiliary high frequency voltage applied to the end cap electrodes 104, a gate voltage applied to the gate electrode 109, and an ion stop voltage applied to the ion stop electrode 110.

The main high frequency voltage is an alternating current voltage having a frequency that is determined by the shape of the ion trap or by a range of the maximum mass to charge ratio of the ions to accumulate. The auxiliary high frequency voltage is capable of outputting a voltage having a wide band frequency, and outputs, according to the purpose, a frequency corresponding to the mass to charge ratio of the ions to eject or corresponding to the mass to charge ratio of to the ions subjected to collision induced dissociation.

The gate voltage and the ion stop voltage are direct current voltages which are switched between a positive voltage and a negative voltage according to the polarity of ionic charges or to the operation of guiding an ion trajectory.

Here, described is a control method when carrying out the MS/MS measurement of a neurotensin trivalent ion of m/z 558.31 generated in the ion source.

The operation of the ion trap can be roughly divided into four phases, an ion accumulation operation 201, an ion isolation operation 202, a collision induced dissociation operation 203 and a mass-separation operation 204.

In the ion accumulation operation 201, −70 V is applied to the gate to guide ions into the ion trap. In this case, by outputting a main high frequency voltage at a voltage of approximately 500 V, a quadrupolar electric field is formed in the ion trap to accumulate the ions.

Next, the ion isolation operation 202 is carried out. +300 V is applied to the gate to entrap the ions into the ion trap.

Then, the main high frequency voltage is increased to approximately 2 kV, and then is stabilized so that the ions can have a natural frequency calculated by Equation (2). Thereafter, a wide band frequency except for the frequency of desired ions is synthesized, and an auxiliary high frequency voltage having the synthesized wave is outputted to the end cap electrode.

With this auxiliary high frequency voltage, the undesired ions except for the desired ions will resonate and be ejected outside the quadrupolar electric field, or will collide with the electrodes and be lost. With these operations, only the desired ions are entrapped in the ion trap.

Next, the collision induced dissociation operation 203 is carried out. In the collision induced dissociation operation 203, an auxiliary high frequency voltage having a wide band frequency corresponding to the desired ions is applied, as in the ion isolation operation 202.

However, the magnitude of this voltage differs from that of the ion isolation operation 202, and is suppressed to such an extent that the ions are not ejected from the ion trap.

Thus, the ions can obtain a potential by the auxiliary high frequency voltage, and collides with neutral molecules of He, Ar or the like, which fill the inside of the ion trap. This energy exceeds a bond energy of the molecule. Consequently, the molecular bond is broken, and fragment ions are generated.

At this time, the main high frequency voltage maintains a voltage that is adjusted in such manner that the generated fragment ions are accumulated in the ion trap.

Finally, the mass-separation operation 204 is carried out. In the mass-separation operation 204, as in the ion isolation operation 202, by fixing the auxiliary high frequency voltage to at a certain frequency and by operating the main high frequency voltage, the ions having a mass to charge ratio corresponding thereto are ejected from the ion trap while sequentially being mass separated.

At this time, a negative voltage is applied to the ion stop electrode in order to guide ions having a positive charge to the detector efficiently.

Note that, in the MS measurement, the ion isolation operation and collision induced dissociation operation are not carried out, but the mass-separation operation is carried out after the ion accumulation operation.

Figure 4:
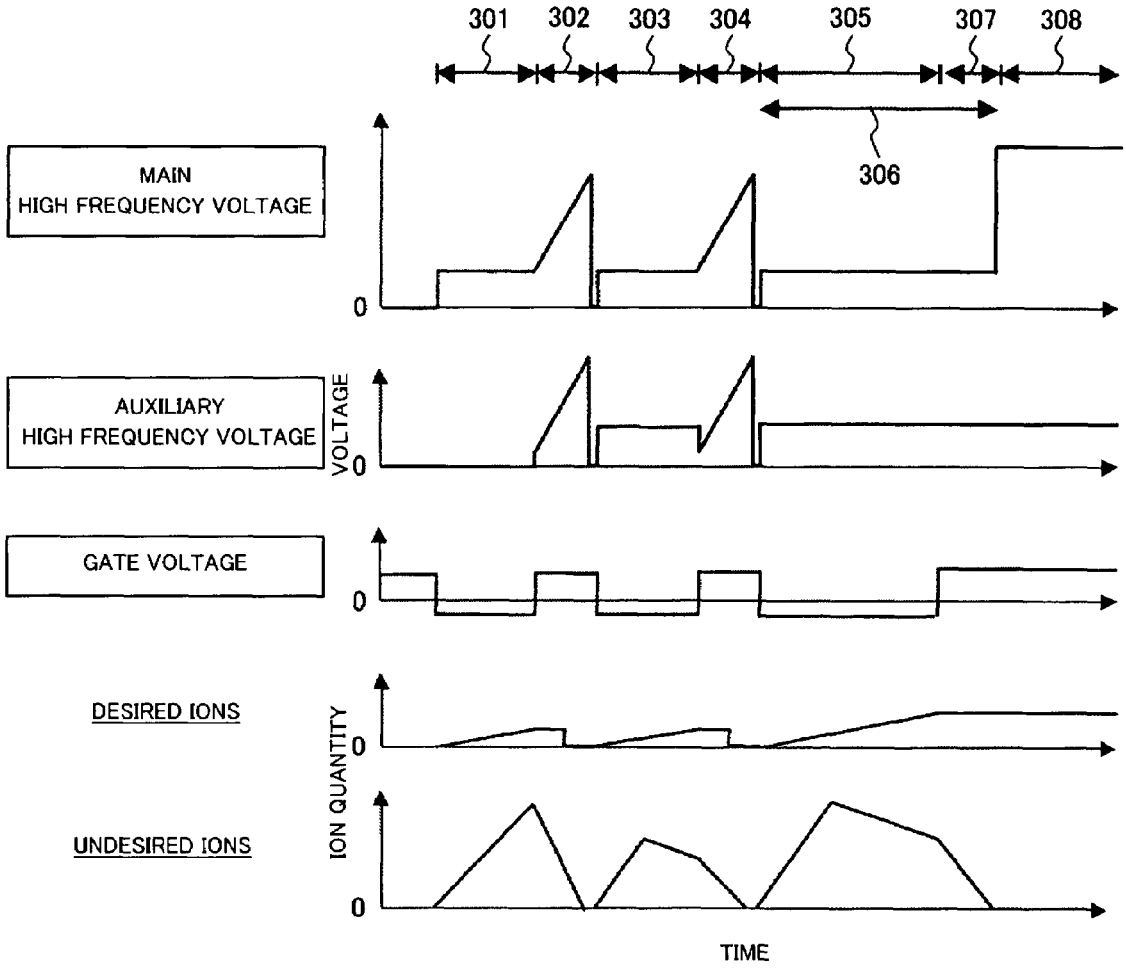
FIG. 4 is a control sequence of the ion trap operation concerning the embodiment of the present invention.
Figure 5:
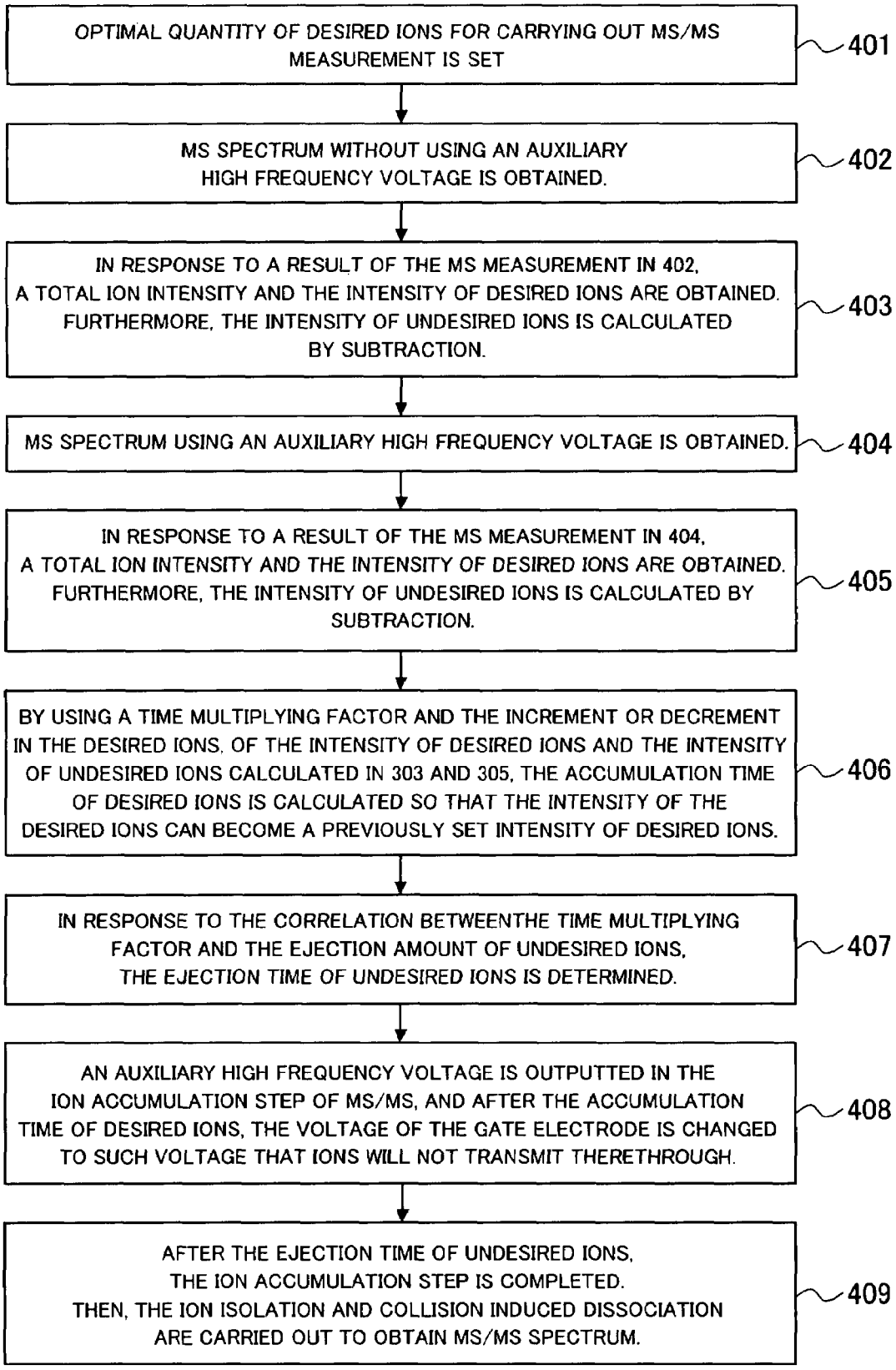
FIG. 5 is a measurement chart concerning the embodiment of the present invention.

In the embodiment of the present invention, in the ion accumulation operation 201 in these ion trap operations, the condition setting of the ion trap is carried out according to the ion trap operation sequence of the embodiment of the present invention shown in FIG. 3, a sequence flow shown in FIG. 4, and a measurement chart shown in FIG. 5, and thereby the quantity of desired ions in the MS/MS measurement is optimized.

Figure 6:
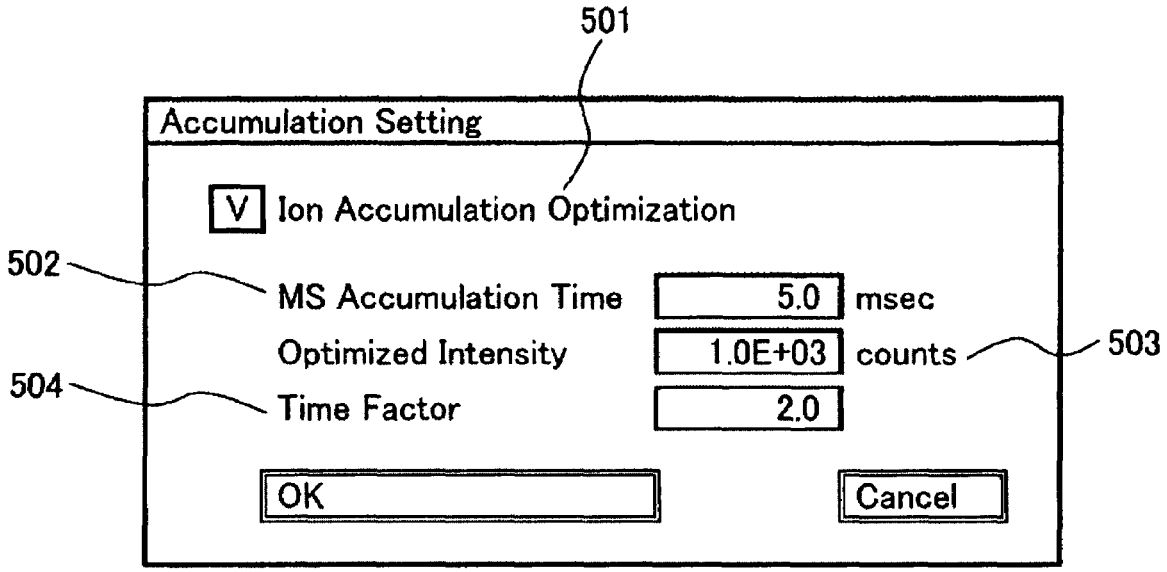
FIG. 6 is a user interface concerning the embodiment of the present invention.

First, the optimal quantity of desired ions for carrying out the MS/MS measurement is determined in 401. An operator inputs this determination using a user interface as shown in FIG. 6.

At first, the on/off concerning the operation of the embodiment of the present invention is set in 501. If checked in 501, masking in 502, 503, 504 is disabled to allow for setting.

Reference numeral 502 represents the ion accumulation time when an auxiliary high frequency voltage is not outputted, and which can be arbitrarily set. Usually, this is set to between approximately 2.0 to 10 msec. Reference numeral 503 represents the ion quantity of desired ions to optimize.

This is set in the unit of the signal strength outputted from the detector. The operation of the embodiment of the present invention is carried out so that the ion quantity of this value can be accumulated in the ion trap during the MS/MS measurement, and thus the ion quantity is adjusted.

Reference numeral 504 represents a preset value inputted as a multiplying factor relative to the ion accumulation time of reference numeral 502, concerning the ion accumulation time when outputting an auxiliary high frequency voltage.

According to the above-described setting condition, the ion trap is operated as follows.

First, MS measurement without outputting an auxiliary high frequency voltage is carried out in 301, 302 and 402 to obtain a mass spectrum.

Then, a total ion intensity is calculated by the obtained mass spectrum in 403. The total ion intensity is a signal strength when all ion intensities are summed without discriminating their masses from the obtained mass spectrum. From this signal strength, the quantity of ions accumulated in the ion trap in the MS measurement is grasped.

Moreover, from the obtained mass spectrum, the signal intensity of desired ions is calculated in 403. On the basis of these signal strength, the ion quantity will be adjusted.

From the previously obtained total ion intensity and ion intensity of desired ions, the ion intensity of undesired ions is calculated. For this calculation, the intensity of undesired ions can be calculated by subtracting the intensity of desired ions from the total ion intensity (403).

Next, the MS measurement when the auxiliary high frequency voltage is outputted is carried out in 303, 304 and 404. In this measurement, the ion accumulation time of the MS measurement in the previous case where an auxiliary high frequency voltage is not outputted, is multiplied by a time factor 504 and modified for measurement.

Then, as in the previous case, the total ion intensity, the intensity of desired ions, and the intensity of undesired ions are calculated from the obtained mass spectrum (405).

Since the quantity of ions accumulated in the ion trap is substantially proportional to the ion accumulation time, the correlation between the time multiplying factor and the amount of increment or decrement in desired ions, and the correlation between the time multiplying factor and the ejection amount of undesired ions can be determined.

From the time multiplying factor and the amount of increment or decrement in the desired ions, the accumulation time of desired ions is calculated so that the desired ions can have the previously set intensity of desired ions. Moreover, from the correlation between the time multiplying factor and the ejection amount of the undesired ions, the ejection time of undesired ions is determined in 406.

Then, MS/MS measurement is started. In the ion accumulation operation of the MS/MS measurement, ions are accumulated through the ion trap sequence shown in 305 and thereafter of FIG. 4.

First, the gate electrode is opened to introduce ions into the ion trap. At the time of starting to introduce them, an auxiliary high frequency voltage is outputted in the ion trap, thereby forming an electric field so as to eject the undesired ions.

Thus, the desired ions are accumulated in the ion trap, while the undesired ions are sequentially ejected from the ion trap. Then, this state is continued during the accumulation time of desired ions 305 so that the quantity of desired ions can become the previously set ion quantity, in 408.

Since the desired ions are accumulated in the ion trap in proportion to time, the gate electrode is closed when the ion quantity becomes the set one.

However, the auxiliary high frequency voltage will be continuously outputted. Without introducing ions into the ion trap by closing the gate electrode, the operation to eject undesired ions is carried out by the auxiliary high frequency voltage.

This operation is continued for a time period 307, which is the time reduced by the accumulation time of desired ions from an ejection time of undesired ions 306.

Accordingly, the undesired ions are completely ejected from the ion trap and only the desired ions are accumulated in the ion trap. As this ion quantity, the optimal quantity for MS/MS measurement can be accumulated in the ion trap.

Then, by carrying out the ion isolation operation, the collision induced dissociation operation, and the mass-separation operation in 308, 409, it is possible to obtain an improvement in the intensity of fragment ions and an excellent reproducible MS/MS spectrum.

Furthermore, in the case where there are more undesired ions and fewer desired ions, the ions that can be accumulated in the ion trap may be saturated. Accordingly, the quantity of desired ions may not be proportional to the accumulation time of the desired ions.

Figure 7:
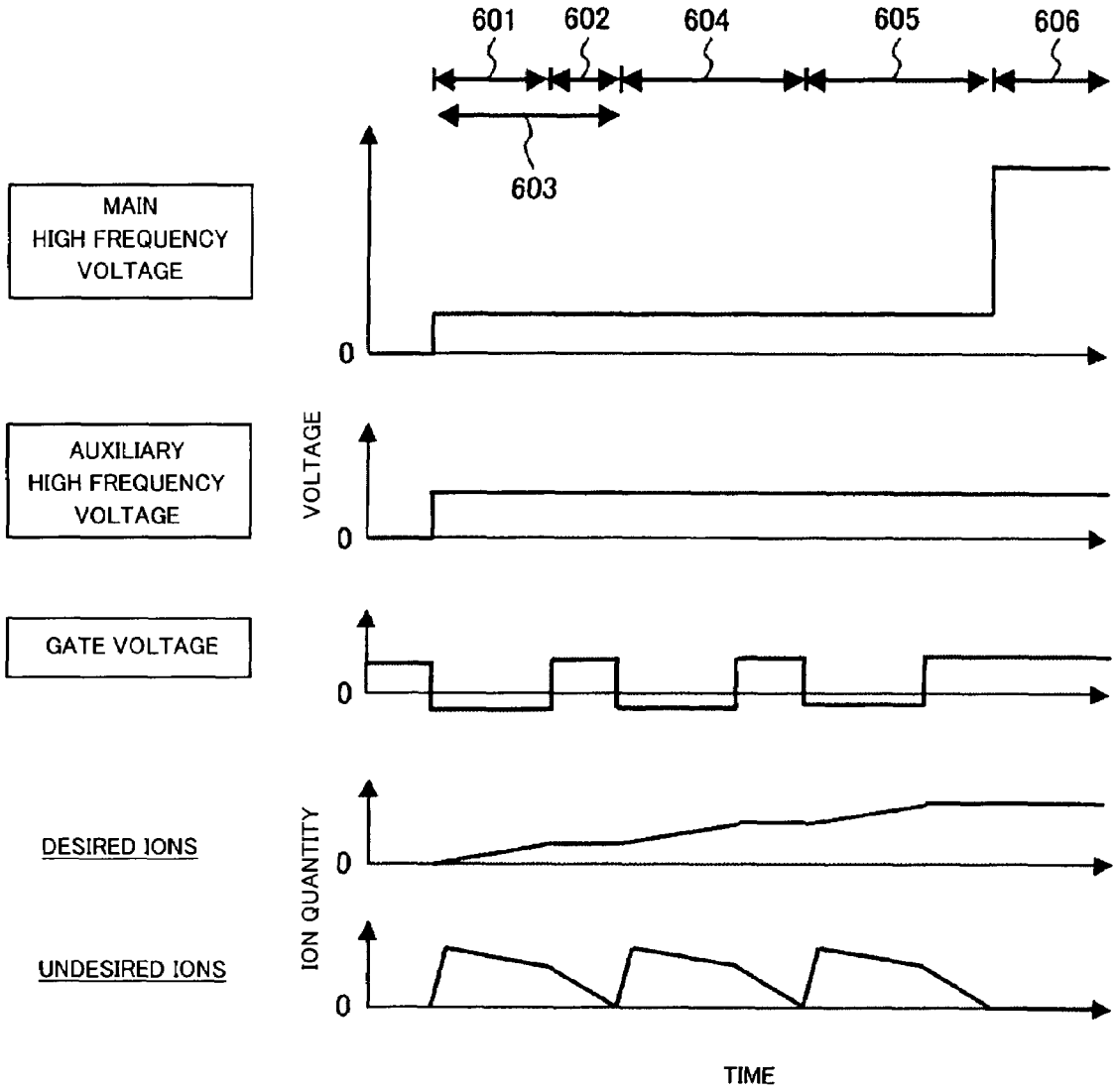
FIG. 7 is a control sequence of the ion trap operation at the time of space charge concerning the embodiment of the present invention.
Figure 8:
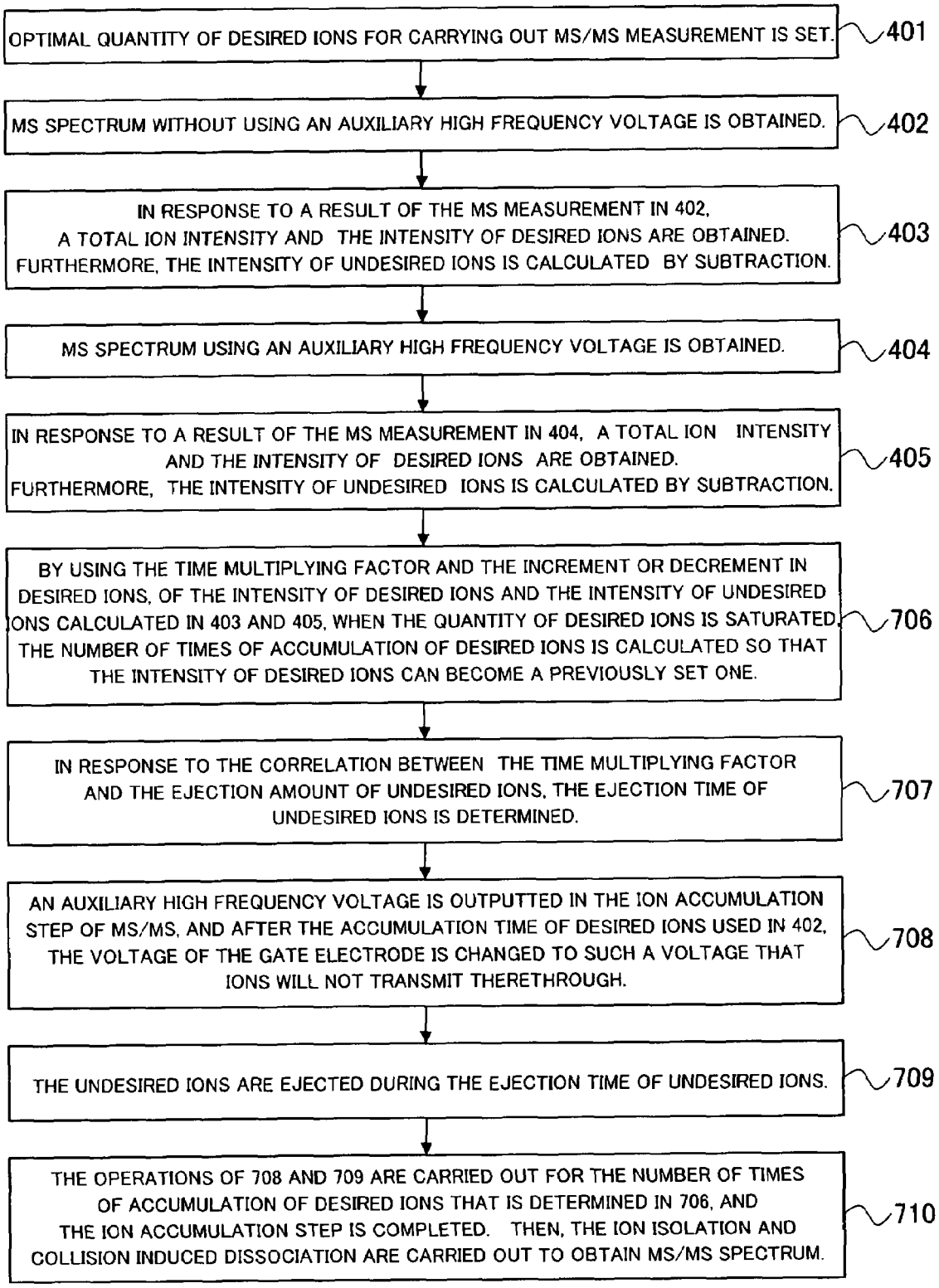
FIG. 8 is a measurement chart at the time of space charge concerning the embodiment of the present invention.

In that case, as shown in a FIG. 7 and FIG. 8, during the ion accumulation time carried out in the MS measurement, the desired ions are accumulated in 601 and the undesired ions are ejected for an ejection time of undesired ions 602. Thereafter, a similar operation 603 is repeated in 604 and 605, and then measurement is carried out so that the quantity of desired ions can become the previously set quantity of desired ions (606).

Operations 706 to 710 shown in FIG. 8 are described.

If the quantity of desired ions is saturated in response to the time multiplying factor of the intensity of desired ions and the intensity of undesired ions calculated in 403 and 405 and in response to the increment or decrement in the desired ions, then the number of accumulations of desired ions is calculated so that the ion intensity can become the previously set quantity of desired ions (706).

From the correlation between the time multiplying factor and the ejection amount of undesired ions, the ejection time of undesired ions is determined (707).

An auxiliary high frequency voltage is outputted in the ion accumulation step of MS/MS, and after the ion accumulation time used in 402, the gate electrode voltage is changed to such voltage that ions will not transmit therethrough (708).

The undesired ions are ejected during the ejection time of undesired ions (709).

The operations of 708 and 709 are carried out for the number of accumulations of desired ions that is determined in 706, and then the ion accumulation step is completed. Thereafter, the ion isolation and collision induced dissociation are carried out to obtain a MS/MS spectrum (710).

FIG. 7 shows a sequence in the case of repeating three times. This allows the space charge in the ion trap to be suppressed and allows only the desired ions to be accumulated in the optimal ion quantity.

In other words, in the ion trap mass spectrometry method shown in FIG. 7, the accumulation step of accumulating desired ions in the ion trap part by ejecting undesired ions while accumulating ions into the ion trap part, and the undesired ion ejection step of ejecting undesired ions that remain in the ion trap part and leaving the desired ions in the ion trap part are repeated alternately.

Thereafter, a step of carrying out collision induced dissociation to the desired ions and thereby breaking the ions, and a step of mass-separating for ejecting the broken ions on the basis of each mass and detecting them in the detector 111 are carried out.

Since the above-described accumulation/collection of desired ions is carried out by repeating the accumulation step and the undesired-ion ejection step, the ion quantity introduced in the ion trap can be limited to that extent not to become excessive in each accumulation step. This can prevent an excessive amount of ion quantity from being introduced into the ion trap. This also dissolves the incomplete ejection of undesired ions caused by bad resonance associated with the excessive amount of introduced ions.

Figure 9:
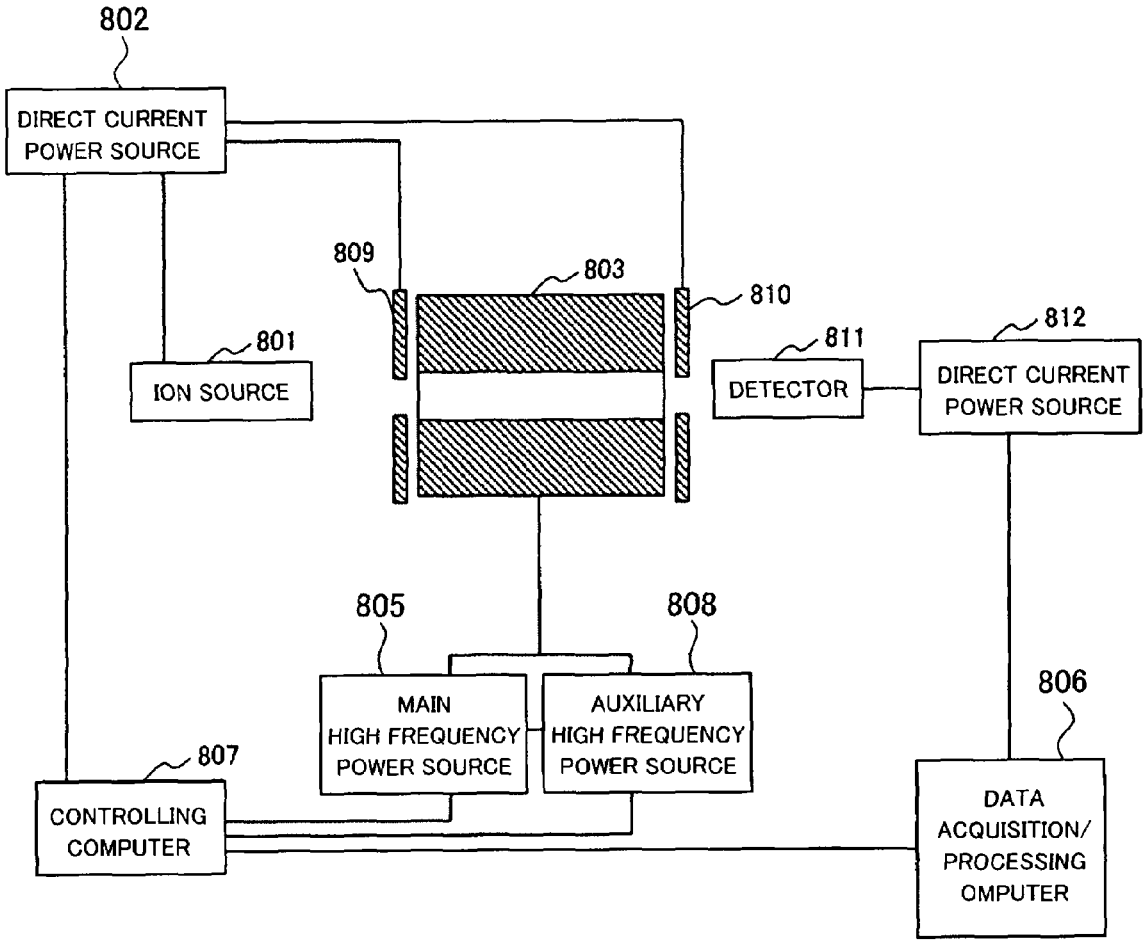
FIG. 9 is a schematic configuration view in a linear ion trap concerning an embodiment of the present invention.

As a second embodiment, a case is described in which a linear ion trap having four pillar-shaped electrodes is employed. FIG. 9 shows a schematic configuration view.

A linear ion trap 803 consists of four pillar-shaped electrodes where a quadrupolar electric field is formed by applying a high frequency voltage between the opposing poles. This is also called a two dimensional ion trap because the electric field is formed in two dimensions.

In order to accumulate ions in the ion trap, an offset voltage in the linear ion trap from a direct current power source 802 is set to a voltage lower than the voltage at a gate electrode 809 and an ion stop electrode 810.

Thus, ions generated from an ion source enter the linear ion trap from the gate electrode 803, and are accumulated in the linear ion trap without being ejected from the ion stop electrode.

For the ejection of ions, as in the three dimensional ion trap, an auxiliary high frequency voltage 808 of a frequency calculated by Equation (2) is superimposed on a main high frequency voltage 805, thereby resonating the ions.

For this reason, the ion isolation operation 202 and the collision induced dissociation operation 203 can be carried out in the same sequence as that of the three-dimensional ion trap shown in FIG. 3.

However, unlike in the three-dimensional ion trap, the mass-separation operation is carried out by a method disclosed in U.S. Pat. No. 5,420,425 or U.S. Pat. No. 6,177,668.

The embodiment of the present invention is the invention concerning the ion accumulation operation, and thus can be controlled in a similar manner in the linear ion trap.

More specifically, if the operation sequences of FIG. 4 and FIG. 7 are carried out, also in the linear ion trap it is possible to optimize the quantity of accumulated ions and the quantity of desired ions in the ion accumulation operation, and thus to suppress the problems due to space charge. In addition, it is also possible to obtain an improvement in the intensity of fragment ions and an excellent reproducible MS/MS spectrum in MS/MS measurement.

As a third embodiment, a case is described in which a mass separation section, such as a time of flight mass spectrometer (TOF) or an ion cyclotron resonance mass spectrometer (FT-ICR), is employed at the subsequent stage of the ion trap.

The ion trap mass spectrometer has an advantage that a plurality of times of MS/MS operations can be carried out, but in contrast it has a drawback that the mass resolution and mass accuracy are poor.

In the fields of protein analysis and metabolomics, not only MS/MS measurement but also mass accuracy lead to an improvement in reliability of the material identification.

Then, by employing TOF and FT-ICR at the subsequent stage of the ion trap in order to compensate the drawback of this ion trap, a plurality of times of MS/MS operations of high resolution and high mass accuracy can be achieved.

In this embodiment, since the mass-separation operation is carried out in the mass spectrometer arranged at the subsequent stage, as to the ion trap, the operations through the collision induced dissociation operation 203 are carried out in the operation sequence shown in FIG. 3.

Then, the ions are delivered to the mass spectrometer at the subsequent stage, and the mass-separation operation is carried out in the mass spectrometer at the subsequent stage.

The embodiments of the present invention are the inventions concerning the ion accumulation operation, and if the operation sequences shown in FIG. 4 and FIG. 7 are carried out, it is possible to optimize the quantity of accumulated ions and the quantity of desired ions in the ion accumulation operation, and thus to suppress the problems due to space charge. In addition, it is also possible to obtain an improvement in the intensity of fragment ions and an excellent reproducible MS/MS spectrum in the MS/MS measurement.

What is claimed is:

1. A method of ion trap spectrometry comprising the steps of:

ionizing a sample using an ion source;

trapping ions generated by the ion source using an ion trap part;

applying a main high frequency voltage to the ion trap part using a main high frequency power source;

applying an auxiliary high frequency voltage to the ion trap part using an auxiliary high frequency power source;

detecting ions ejected from the ion trap part using a detector;

accumulating desired ions into the ion trap part by ejecting undesired ions while accumulating ions into the ion trap part;

ejecting undesired ions that remain in the ion trap part and leaving the desired ions in the ion trap part, wherein the accumulating and ejecting steps are repeated alternately;

breaking ions by carrying out a collision induced dissociation to the desired ions to break the ions after the accumulation step and the undesired ion ejection step are repeated; and mass-separating for ejecting broken ions on the basis of each mass and for detecting the same in the detector, wherein:

the quantity of desired ions is adjusted to a predetermined value that is optimal for MS/MS measurement by calculating the number of times the accumulating step should be repeated to achieve the predetermined value and repeating the accumulating step and the ejecting step the calculated number of times.

2. The ion trap mass spectrometry method according to claim 1, wherein the ion trap part is a three dimensional ion trap including a ring electrode and a pair of end cap electrodes.

3. The ion trap mass spectrometry method according to claim 1, wherein the ion trap part is a linear ion trap having four pillar-shaped electrodes.

4. The ion trap mass spectrometry method according to claim 1, wherein correlation between time and the desired ion quantity is calculated according to two times of MS measurements having different ion accumulation times, and in response to this correlation, the ion accumulation time is determined so as to obtain the value that is optimal for MS/MS measurement quantity of desired ions.

5. The ion trap mass spectrometry method according to claim 1, wherein when there is no proportional relationship between time and the ion quantity due to space charge in the ion trap part, after carrying out a plurality of ion accumulation operations, the predetermined optimal value of ion quantity is reached, and the MS/MS measurement is carried out.

6. The ion trap mass spectrometry method according to claim 1, wherein the predetermined optimal value of ion quantity to can be set arbitrarily by a user interface.

7. The ion trap mass spectrometry method according to claim 1, wherein a total ion quantity and a quantity of desired ions are observed according to a previously measured MS measurement;

by use of these ion quantities, a quantity of undesired ions is calculated; and in response to this quantity of undesired ions, an optimum ejection for ejecting the undesired ions is determined and operated.

* * * * *

UNITED STATES PATENT AND TRADEMARK OFFICE

CERTIFICATE OF CORRECTION

PATENT NO. : 7,989,764 B2
APPLICATION NO. : 11/889232
DATED : August 2, 2011
INVENTOR(S) : Hiroyuki Yasuda et al.

It is certified that error appears in the above-identified patent and that said Letters Patent is hereby corrected as shown below:

IN THE CLAIMS:

In Column 12, Line 23 (Claim 6), please delete "to" after "value of ion quantity", should read, -- the predetermined optimal value of ion quantity can be set... --

Signed and Sealed this
Twenty-first Day of February, 2012

David J. Kappos

David J. Kappos
*Director of the United States Patent and Trademark Office*